US012729494B2

(12) United States Patent
Vidamo

(10) Patent No.: US 12,729,494 B2
(45) **Date of Patent: *Sep. 8, 2026**

(54) ULTRA-SHALLOW BOLLARD ASSEMBLY

(71) Applicant: Allied Tube & Conduit Corporation, Harvey, IL (US)

(72) Inventor: Cain Vidamo, West Covina, CA (US)

(73) Assignee: Allied Tube & Conduit Corporation, Harvey, IL (US)

( * ) Notice: Subject to any disclaimer, the term of this patent is extended or adjusted under 35 U.S.C. 154(b) by 661 days.

This patent is subject to a terminal disclaimer.

(21) Appl. No.: 18/127,335

(22) Filed: Mar. 28, 2023

(65) Prior Publication Data

US 2024/0328100 A1 Oct. 3, 2024

(51) Int. Cl.
*E01F 9/658* (2016.01)
*E01F 9/623* (2016.01)

(52) U.S. Cl.
CPC ..... *E01F 9/658* (2016.02); *E01F 9/623* (2016.02)

(58) Field of Classification Search
CPC ..... E01F 9/623; E01F 9/658; E01F 9/685
See application file for complete search history.

(56) References Cited

U.S. PATENT DOCUMENTS

| | | | | |
|---|---|---|---|---|
| 7,607,856 | B2 | 10/2009 | Patel | |
| 7,775,738 | B2 | 8/2010 | Darcy | |
| 11,174,606 | B1 * | 11/2021 | Lamore | E01F 13/026 |
| 11,578,468 | B1 * | 2/2023 | Kramps | E01F 9/685 |
| 12,410,568 | B2 * | 9/2025 | Owens | E01F 9/685 |
| 2007/0086858 | A1 | 4/2007 | Morgan | |
| 2009/0028638 | A1 * | 1/2009 | Crawford | E01F 13/12 404/6 |
| 2025/0347064 | A1 * | 11/2025 | Vidamo | E01F 9/623 |

FOREIGN PATENT DOCUMENTS

| | | | | |
|---|---|---|---|---|
| GB | 2582789 A | * | 10/2020 | E01F 15/003 |
| GB | 2629359 A | * | 10/2024 | E01F 9/685 |

OTHER PUBLICATIONS

Author Unknown., "Enhancing Safety and Mitigating Risk: The Importance of Crash-Rated Vehicle Barrier Protection for City Outdoor Events" Barrier1™ Jun. 6, 2023 URL: https://barrier1.com/our-products/high-security-bollards/model-smb-1200-sa-astm-m50-k12/.

Author Unknown., "UltraShallow Bollards" Gibraltar—Brochure, dated Jul. 16, 2020, 2 pages.

Author Unknown., "DSC633 General Arrangement and Foundation Spec" Delta Scientific Corporation—Brochure, dated Jul. 23, 2021.

Author Unknown., "Crash-Rated Bollards"—Atlas Security Products Inc.—URL: https://atlasbarriers.com/bollards/.

* cited by examiner

*Primary Examiner* — Gary S Hartmann
(74) *Attorney, Agent, or Firm* — KDW FIRM PLLC

(57) ABSTRACT

A bollard assembly, including a main body surrounding a post, wherein the main body is operable to be positioned below grade, and wherein the post is operable to extend above grade. The main body may include an upper plate including an opening to receive the post, a lower plate opposite the upper plate, and a plurality of support members extending between the upper plate and the lower plate, wherein two or more support members of the plurality of support members extend radially from a central axis extending through the post. The bollard assembly may further include a support assembly coupleable with the main body, wherein the support assembly includes at least one support bar insertable between the upper plate and the lower plate.

20 Claims, 8 Drawing Sheets

ULTRA-SHALLOW BOLLARD ASSEMBLY

BACKGROUND OF THE DISCLOSURE

Field of the Disclosure

The present disclosure relates to vehicle barriers and, more particularly, to an ultra-shallow bollard assembly.

Discussion of Related Art

With security risks on the rise, there is a need for protection devices to defend sensitive areas including, but not limited to, stadiums/arenas, fairgrounds, amphitheaters, airports, urban places of public gatherings, bus stops, sidewalks, places of worship, data centers, public utilities, prisons, governmental buildings, corporate campuses, storefronts, and all other spaces that have interaction between foot traffic and vehicular traffic. Bollards are one type of protection device currently being used. Bollards typically include steel pipes (optionally filled with concrete) embedded into the ground to a depth of 48 inches, for example. However, the installation of bollards requires the excavation and disposal of earth by backhoe, or by drilling, approximately 36" diameter holes by 60" deep. This process often requires costly underground utility relocation, particularly in urban settings, as most utilities are located 36" to 48" below grade.

It is with respect to this and other drawbacks of the prior art that the present disclosure is provided.

SUMMARY OF THE DISCLOSURE

This Summary is provided to introduce a selection of concepts in a simplified form further described below in the Detailed Description. This Summary is not intended to identify key features or essential features of the claimed subject matter, nor is the summary intended as an aid in determining the scope of the claimed subject matter.

In one approach, a vehicle barrier may include a main body surrounding a post, wherein the main body is operable to be positioned below grade, and wherein the post is operable to extend above grade. The main body may include an upper plate including an opening to receive the post, a lower plate opposite the upper plate, and a plurality of support members extending between the upper plate and the lower plate, wherein two or more support members of the plurality of support members extend radially from a central axis extending through the post. The vehicle barrier assembly may further include a support assembly coupleable with the main body, wherein the support assembly includes at least one support bar insertable between the upper plate and the lower plate.

In another approach, a bollard assembly may include a main body surrounding a post, wherein the main body is operable to be positioned below grade, wherein the post is operable to extend above grade, and wherein the main body includes an impact end and a back end. The main body may include an upper plate including an opening to receive the post, a lower plate opposite the upper plate, and a plurality of support members extending between the upper plate and the lower plate, wherein two or more support members of the plurality of support members extend radially from a central axis extending through the opening and the post. The bollard assembly may further include a support assembly extending from the back end of the main body, wherein the support assembly includes a support bar insertable between the upper plate and the lower plate.

In yet another approach, a bollard assembly may include a main body surrounding a post, wherein the post extends perpendicular to the post, wherein the main body is operable to be positioned below grade, and wherein the post is operable to extend above grade. The main body may include an upper plate including a first opening to receive the post, a lower plate opposite the upper plate, wherein the lower plate includes a second opening to receive the post, and a plurality of support members extending between the upper plate and the lower plate, wherein two or more support members of the plurality of support members extend radially from a central axis extending through the opening and the post. The bollard assembly may further include a support assembly coupleable with the main body, wherein the support assembly includes a support bar insertable between the upper plate and the lower plate.

BRIEF DESCRIPTION OF THE DRAWINGS

The accompanying drawings illustrate exemplary approaches of the disclosed embodiments so far devised for the practical application of the principles thereof, and in which.

Figure 1:
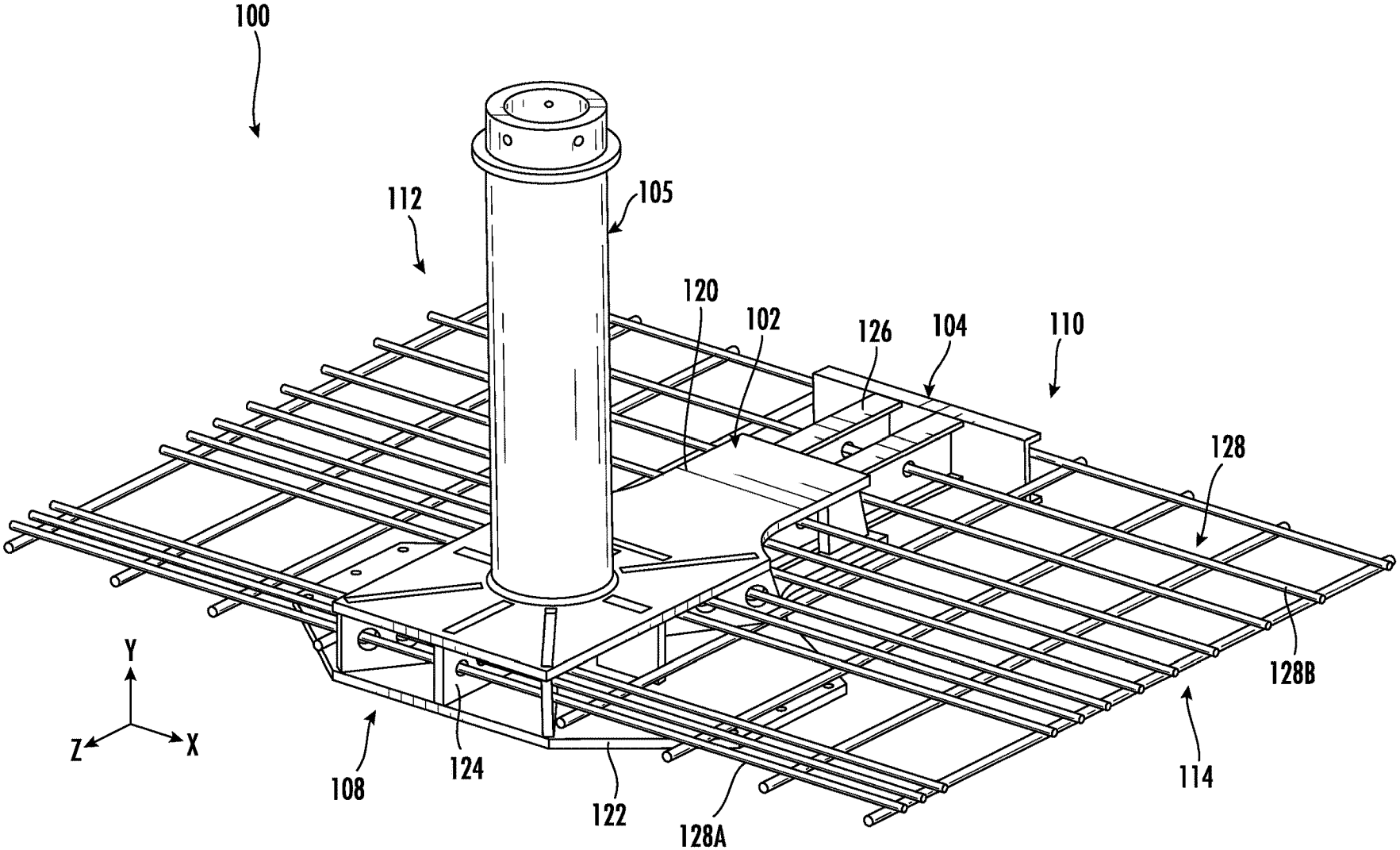
FIG. 1 is a perspective view of an ultra-shallow bollard assembly according to embodiments of the present disclosure.

The drawings are not necessarily to scale. The drawings are merely representations, not intended to portray specific parameters of the disclosure. The drawings are intended to depict exemplary embodiments of the disclosure, and therefore are not to be considered as limiting in scope. In the drawings, like numbering represents like elements.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DESCRIPTION OF EMBODIMENTS

The present disclosure will now proceed with reference to the accompanying drawings, in which various approaches are shown. It will be appreciated, however, that the re-usable snap-in fitting may be embodied in many different forms and should not be construed as limited to the approaches set forth herein. Rather, these approaches are provided so that this disclosure will be thorough and complete, and will fully convey the scope of the disclosure to those skilled in the art.

Mitigation of a hostile 15,000 lb vehicle traveling at a rate of 50 mph by limiting the penetration of the leading edge of the vehicle's trailer within 1 m of the leading edge of the barrier (M50/P1) in an urban environment is challenging, particularly where an existing environment prohibits the installation of typical barrier systems requiring more than 10" of foundation embedment depth. In an urban environment, for example, certain features of the existing infrastructure differ from "perfect world" conditions prescribed within the F2656-20 crash-test method standard, which requires a level of modularity to maintain product performance in different field conditions. To address this, a bollard assembly of the present disclosure has been designed to include a separate "kickbar," which installs into the base-sled of the bollard assembly, and can be positioned to best fit the built environment the bollard assembly is being installed into.

In some embodiments, the bollard assembly of the present disclosure may include a main body surrounding a post, wherein the main body is operable to be positioned below grade, and wherein the post is operable to extend above grade. The post may be assembled through openings in the main body and welded, wherein the main body includes two or more plates that are fit together to create the assembly. The separate kick-bar can be modular and inserted during in-field, contractor installation. Although not limited to any particular dimensions, the post may have an outer diameter of approximately 11.5," and may withstand an impact load from a 15,000 lb vehicle traveling at 50 mph by transferring energy to the main body beneath grade. More specifically, during vehicular impact, the force is extended to the kick-bar, which resists upheaval of the assembly through a concrete foundation formed around the main body.

Referring now to FIGS. 1, an exemplary bollard assembly 100 (hereinafter "assembly") according to embodiments of the present disclosure will be described in greater detail. As shown, the assembly 100 may include a main body 102, and a support assembly 104 ("kick-bar") extending from the main body 102. A bollard post 105 (hereinafter "post") may extend vertically from the main body 102. The assembly 100 may include a front 108, a back 110, a first side 112, and a second side 114. During installation, the assembly 100 may be oriented such that the front 108 is facing the most likely direction of impact (e.g., from a vehicle). As shown, the post 105 may be positioned closer to the front 108 than to the back 110. It will be appreciated that the assembly 100 can also block a variety of different types of vehicles traveling in different directions.

When installed and during use, the post 105 is oriented upright and substantially perpendicular to the ground, such that the top of the post 105 is at a predetermined height above the ground. The predetermined height of the post 105 is adequate enough to prevent vehicles from driving over the post 105 in an attempt to access the secure area protected by the assembly 100. Although non-limiting, the height of the post 105 is approximately thirty to fifty inches above the ground. A predetermined portion of the post 105 is generally installed below the ground. One skilled in the art will recognize that the post 105 can comprise various shapes and sizes, while still maintaining its intended purpose. Generally, the post 105 is a cylindrical tube made of a durable material. In one embodiment, the post 105 is an upright cylindrical tube constructed from heavy gauge steel pipe. Further, the post 105 can be of varying diameters depending on the desired crash rating capabilities. For example, the post 105 can have a diameter between approximately eight inches and twelve inches in order to meet most crash test ratings.

Although not shown, an optional bollard sleeve may be adapted to substantially surround the portion of the post 105 above the ground. The bollard sleeve may be decorative in nature, such that the post 105 can be covered with a bollard sleeve customized to match the architectural setting of the surrounding area. Accordingly, the decorative bollard sleeve 110 can be designed in a variety of styles and colors in order to aesthetically correspond with the landscape of the facility or secured area. Furthermore, lighting fixtures or other accessories, attachments, signage or applicable modular devices may be part of the post 105 in alternative embodiments. Although not shown, a cap or cover may be added to the top of the post 105.

As will be described in greater detail herein, the main body 102 may include an upper plate 120, a lower plate 122, and a plurality of support members 124 extending between the upper and lower plates 120, 122. The support assembly 104 may include one or more support bars 126 extendible within an interior of the main body 102.

As further shown, the assembly 100 may include a plurality of reinforcing bars 128 (e.g., rebar) extending through the main body 102 and the support assembly 104. More specifically, a first reinforcing bar 128A of the plurality of reinforcing bars 128 extends through at least two support members 124 of the main body 102, while a second reinforcing bar 128B of the plurality of reinforcing bars 128 extends through the support bar 126 of the support assembly 104. Although not limited to any specific dimensions, the reinforcing bars 128 extending in the x-direction may each be approximately 110" in length, while the reinforcing bars 128 extending in the z-direction may be approximately 78".

Figure 2A:
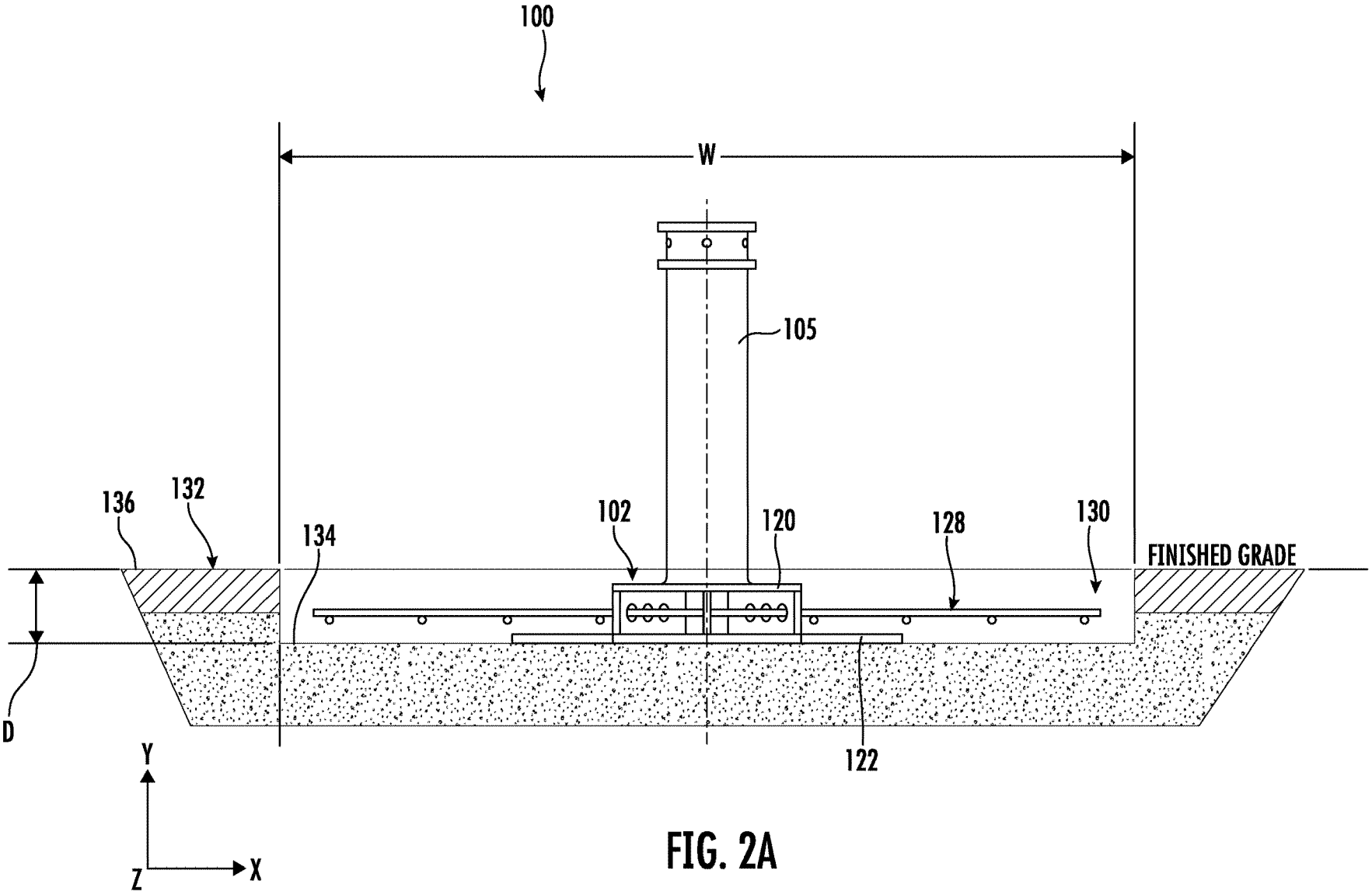
FIGS. 2A-2B are side views of the ultra-shallow bollard assembly according to embodiments of the present disclosure.
Figure 2B:
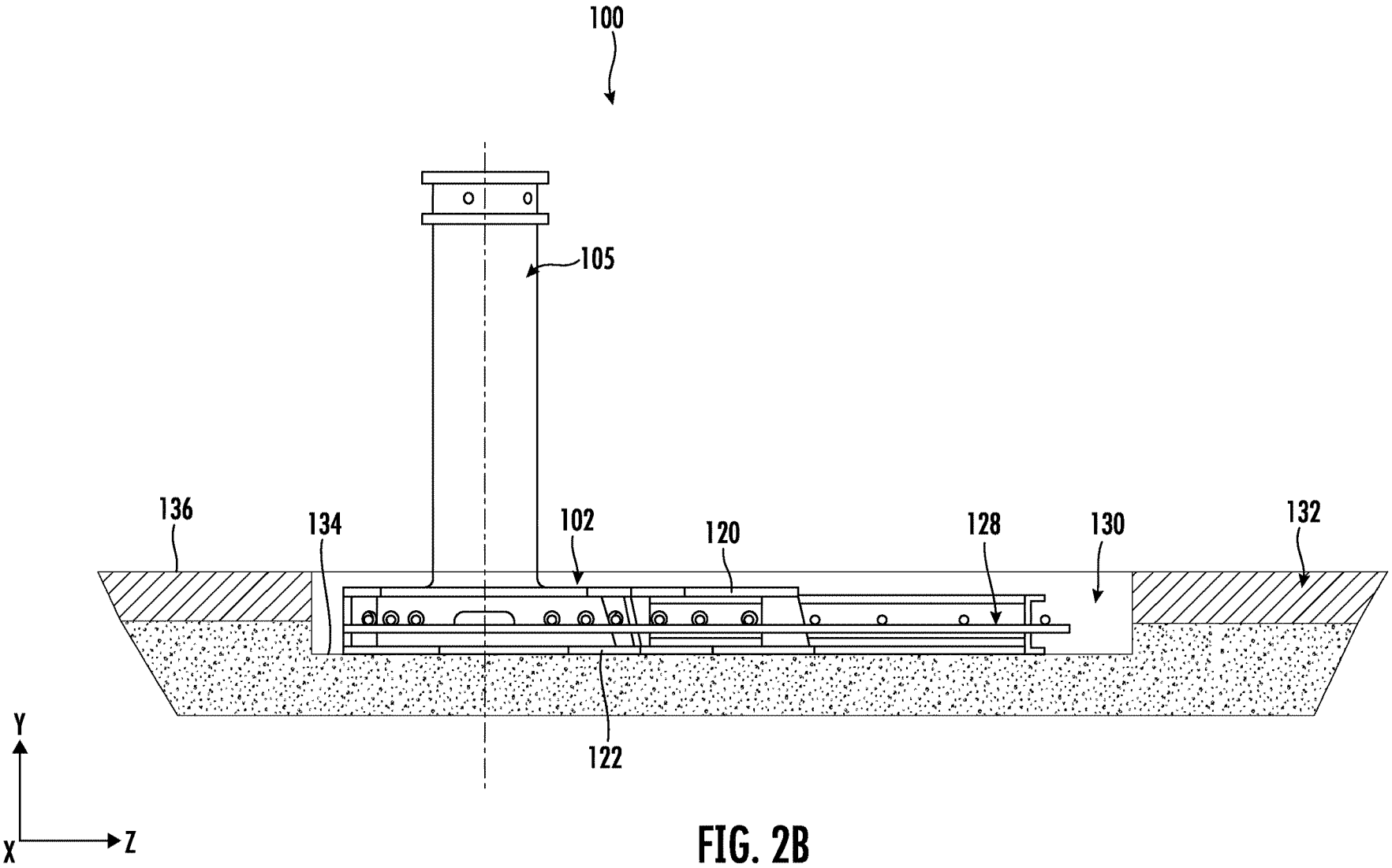

As shown in FIGS. 2A-2B, the assembly 100 is an "ultra-shallow" bollard assembly designed to be positioned within a cavity 130 of the ground 132. In the non-limiting embodiment shown, the cavity 130 may have a depth 'D' of approximately 10" and a width 'W' of approximately 120". The lower plate 122 of the main body 102 may be positioned atop a bottom surface or layer 134 of the ground 132, while the upper plate 120 may be recessed below an upper layer 136 of the finished grade of the ground 132. Although not present for ease of viewing, the main body 102 can be embedded in a firm substrate (e.g., 3000 PSI concrete foundation), while the post 105 extends upwardly above the upper layer 136 of the ground 132. The concrete may be poured over the main body 102 and the plurality of reinforcing bars 128 after the assembly 100 is positioned within the cavity 130.

Figure 3A:
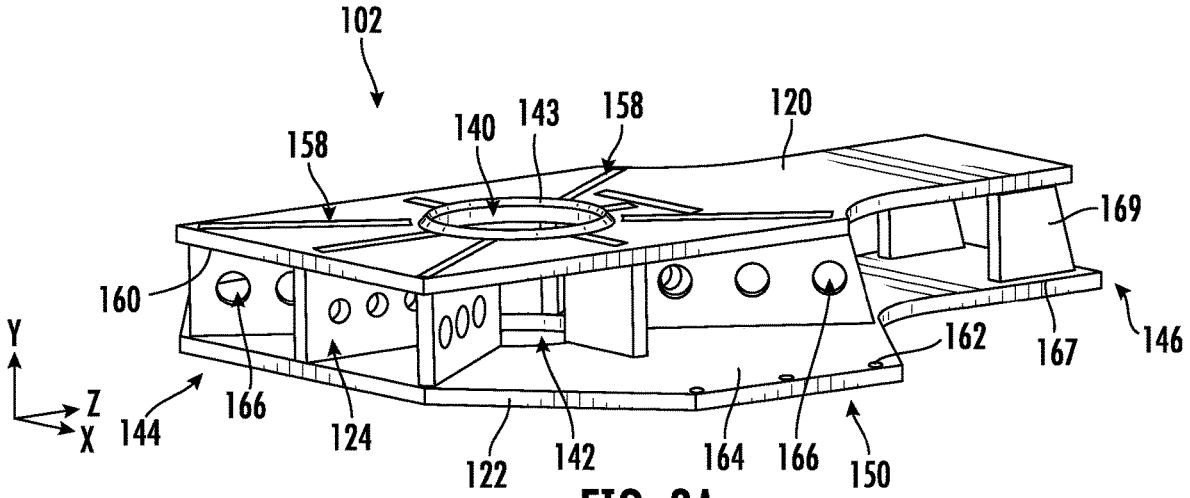
FIG. 3A is a perspective view of a main body of the ultra-shallow bollard assembly according to embodiments of the present disclosure.
Figure 3B:
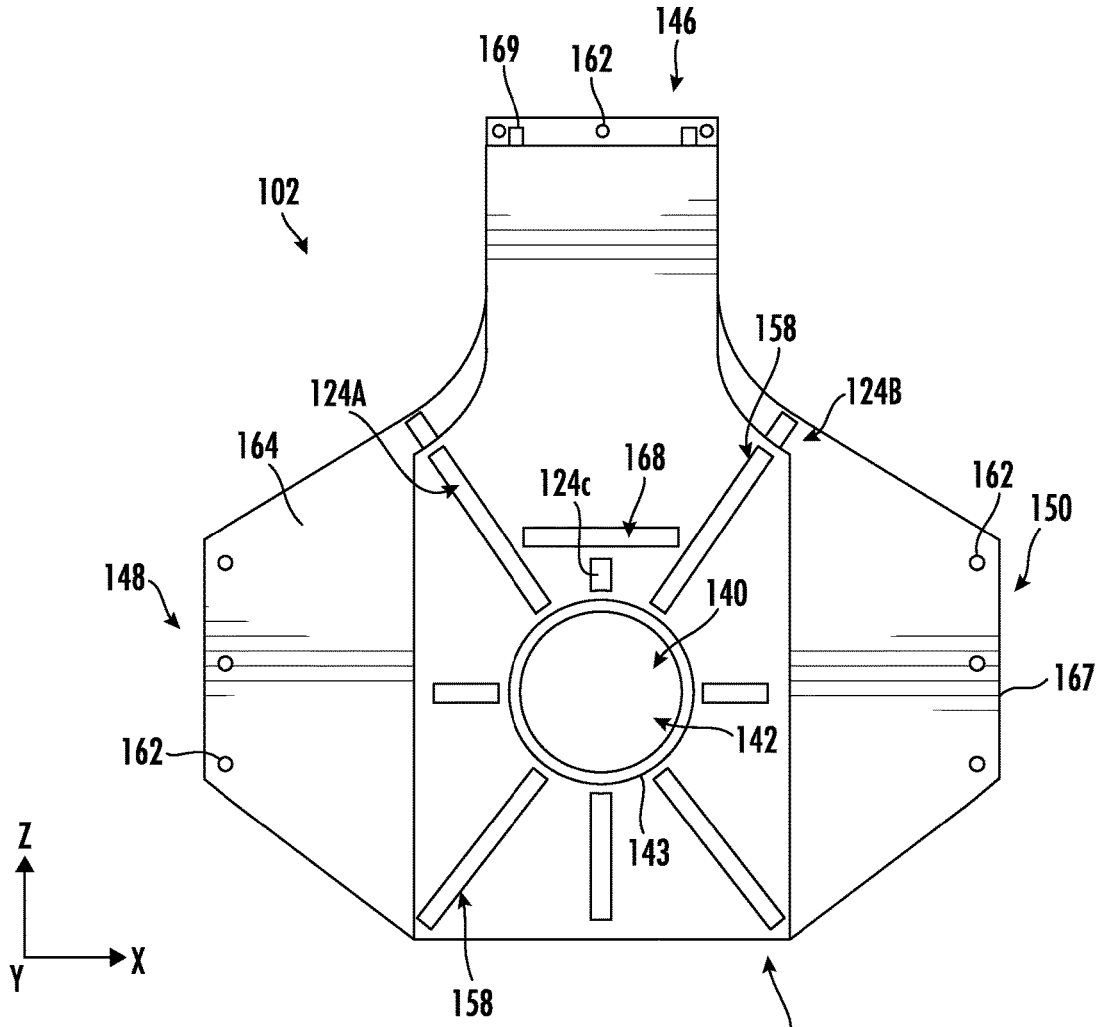
FIG. 3B is a top view of the main body of the ultra-shallow bollard assembly according to embodiments of the present disclosure.
Figure 3C:
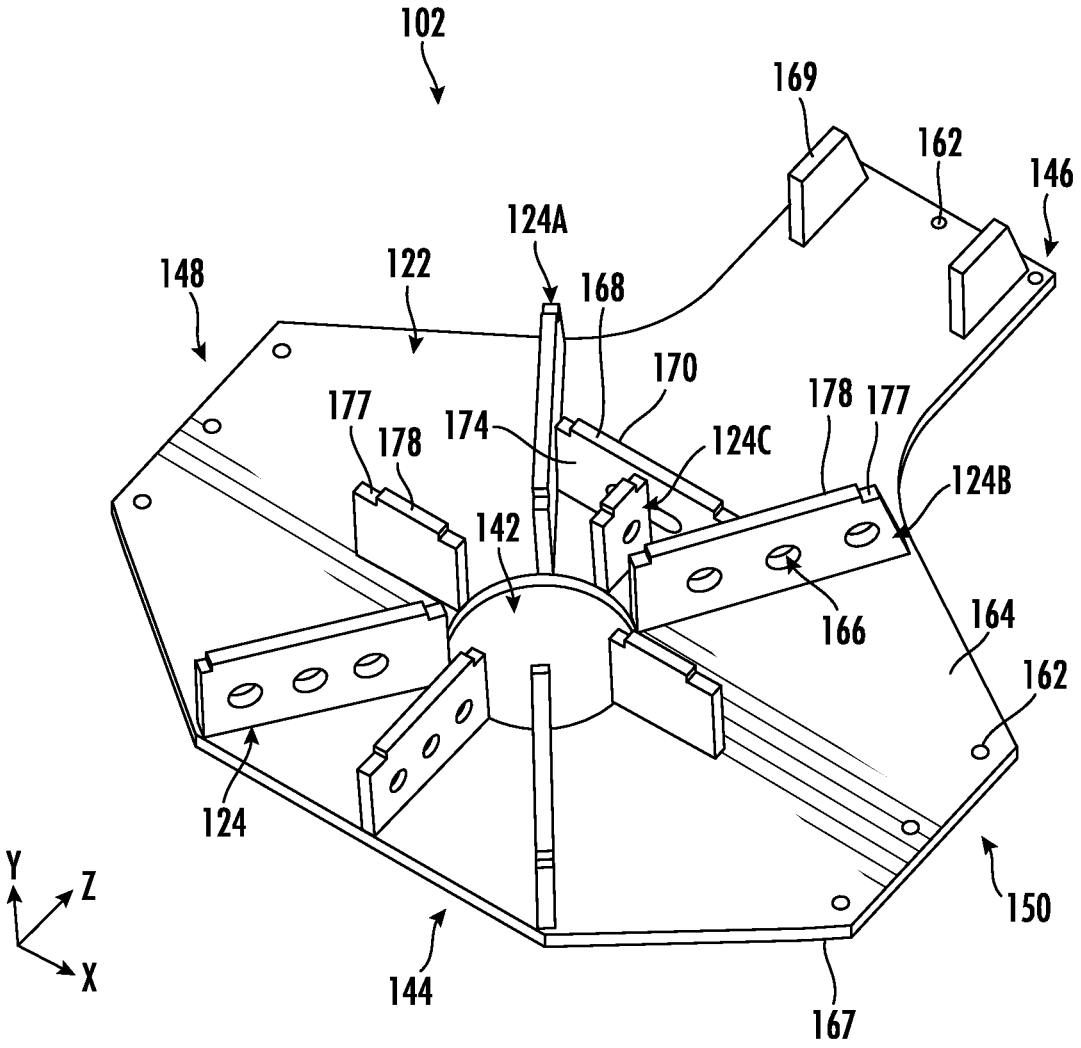
FIG. 3C is a perspective view of a plurality of support members of the main body of the ultra-shallow bollard assembly according to embodiments of the present disclosure.

Turning now to FIGS. 3A-3C, the main body 102 of the assembly 100 will be described in greater detail. As shown, the upper plate 120 of the main body 102 may include a first opening 140 to receive the post 105 (not shown), and the lower plate 122 may include a second opening 142 to also receive the post 105. The upper plate 120 may include a reinforcement ring 143 extending around a perimeter of the first opening 140. Although non-limiting, the upper plate 120 and the lower plate 122 may extend substantially parallel to one another. The main body 102 may include a first end 144 opposite a second end 146, and a first side 148 opposite a second side 150. A length dimension taken between the first and second ends 144, 146 may be approximately 57", and a width dimension taken between the first and second sides 148, 150 may be approximately 55". In some embodiments, a length dimension taken between the first end 144 and a centerline extending through the first and second openings 140, 142 may be approximately 17". In the embodiment shown, the upper plate 120 and the lower plate 122 are A36 steel plates.

In some embodiments, the upper plate 120 may include a plurality of openings or slots 158, which are each operable to receive a corresponding support member 124. As shown, the slots 158 are generally oriented to radiate from the first opening 140. In some embodiments, one or more of the slots 158 may extend entirely through the upper plate 120. In other embodiments, one or more of the slots 158 may extend only partially through the upper plate 120. For example, the slots 158 may be formed as recesses along an underside 160 of the upper plate 120.

In some embodiments, a width of the lower plate 122 may be greater than a width of the upper plate 120. For example, the width of the lower plate 122 may be approximately 55", while the width of the upper plate 120 may be approximately 28". The greater width of the lower plate 122 provides increases lateral stability for the main body 102 and also provides an enlarged landing area for the subsequently poured concrete. In some embodiments, the lower plate 122 may include a plurality of openings 162 operable to receive a plurality of fasteners or anchors for securing the lower plate 122 to the bottom layer 134 of the ground 132.

The main body 102 may further include the plurality of support members 124 extending between the upper plate 120 and the lower plate 122. Each of the support members 124 may be a steel plate extending vertically from an upper surface 164 of the lower plate 122, wherein at least some of the support members 124 include multiple openings 166 formed therein. Although not shown, the openings 166 may receive the reinforcing bars 128 to further secure the main body 102 with the concrete.

As further shown, at least some of the support members 124 may extend radially from the first opening 140 and the second opening 142. This radial positioning of the support members 124 allows a force to be received and transferred in multiple directions. One or more of the support members 124 may extend entirely between the second opening 142 and an outer perimeter 167 of the lower plate 122. One or more of the support members 124 may extend into the slots 158 of the upper plate 120. As shown in FIG. 3C, the support members 124 include notched corners 177 operable to engage the underside 160 of the upper plate 120, and a central tab or protrusion 178 operable to extend into the slots 158 of the upper plate 120. In some embodiments, a top surface of each central protrusion 178 is flush with an upper surface of the upper plate 120.

As further shown, the plurality of support members 128 may include a stop member 168 and a set of guide members 169. As shown, the set of guide members 169 may be located at the second end 146 of the main body 102, and may be operable to receive the support assembly 104 (not shown) therebetween. The set of guide members 169 help to prevent side-to-side movement of the support assembly 104 when the support assembly 104 is inserted between the upper plate 120 and the lower plate 122. As best shown in FIG. 3C, the stop member 168 may be a steel plate oriented perpendicular to the set of guide members 169, wherein an outer surface 170 of the stop member 168 is designed to engage/abut an end of the support assembly 104 when the support assembly 104 is inserted between the upper plate 120 and the lower plate 122. In some embodiments, the stop member 168 may abut support member 124A and support member 124B for increased stability. To further reinforce the stop member 168, support member 124C may be positioned between the second opening 142 and an inner surface 174 of the stop member 168. Support member 124C may be in abutment with the post 105 (not shown).

Figure 4:
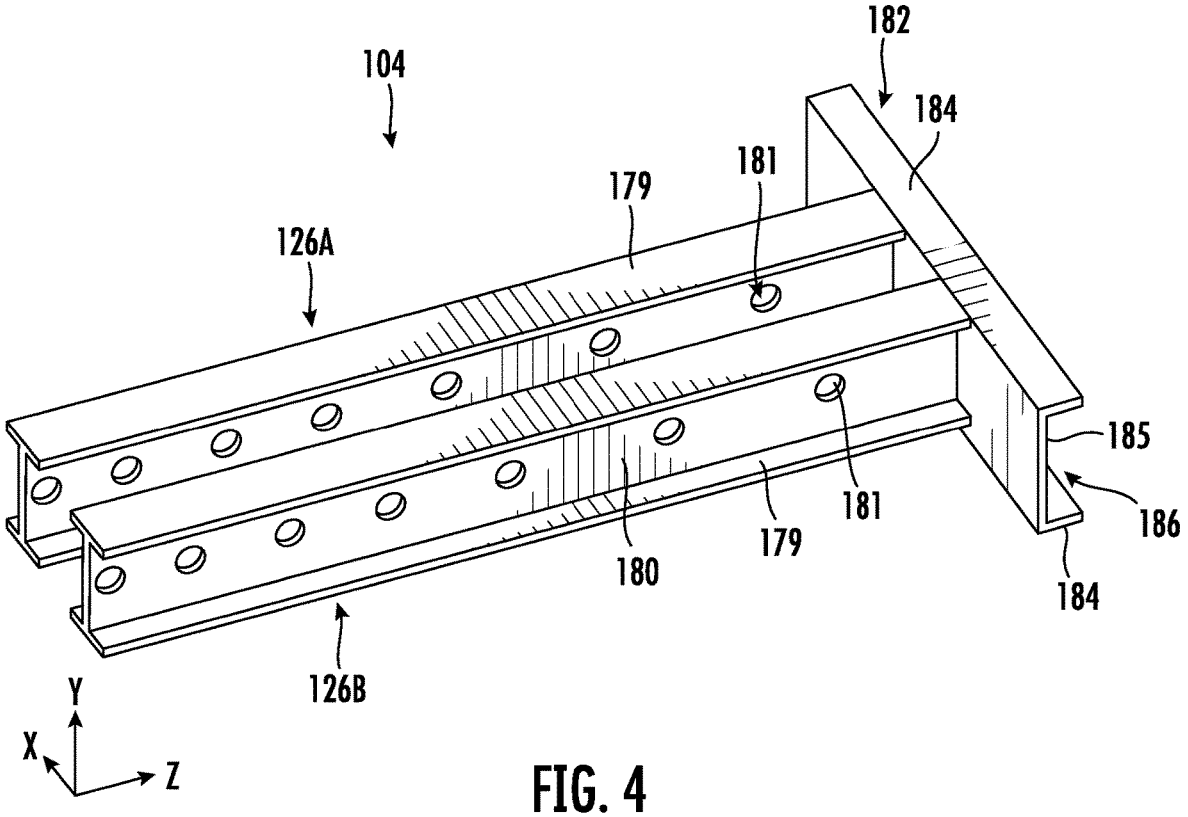
FIG. 4 is a perspective view of a support assembly of the ultra-shallow bollard assembly according to embodiments of the present disclosure.

Turning now to FIG. 4, the support assembly 104 will be described in greater detail. As shown, the support assembly 104 may include first and second support bars 126A, 126B extendible within the interior of the main body 102, wherein the first and second support bars 126 extend generally parallel to one another. However, a parallel arrangement is not dispositive. Each of the support bars 126 may be a steel I-beam including a pair of flanges 179 and a central neck region 180. A plurality of openings 181 may be formed through the neck region 180 to receive the plurality of reinforcing bars 128. As shown, the openings 181 of the first support bar 126A are generally aligned with the openings 181 of the second support bar 126B such that a same reinforcing bar 128 extends through both of the first and second support bars 126A, 126B.

The support assembly 104 may further include a cross member 182 coupled (e.g., welded) to the first and second support bars 126A, 126B. The cross member 182 may have a C-shaped profile defined by upper and lower members 184 and a central member 185. In some embodiments, one or more reinforcing members 128 may be positioned within a cavity 186 defined by the cross-member 182 to help limit movement of the support assembly 104 along the z-direction. During use, the support assembly 104 prevents, or significantly limits, the main body 102 from being lifted vertically (e.g., along y-direction) in the event an impact is received by the post 105. It will be appreciated that an amount that the support assembly 104 extends from the main body 102 may be adjusted prior to the concrete being poured over the main body 102 and the support assembly 104.

Figure 5:
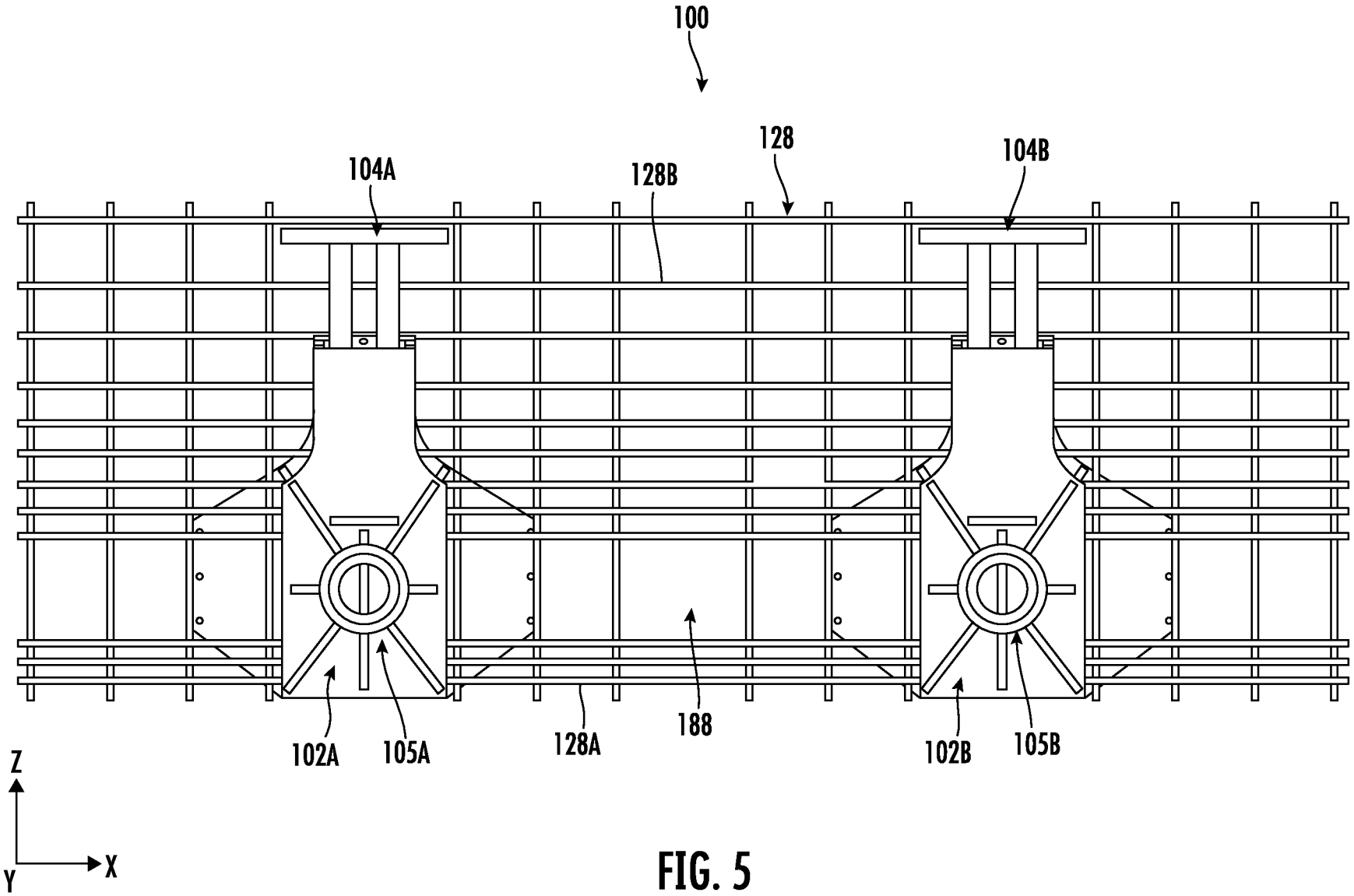
FIG. 5 is a perspective view of another ultra-shallow bollard assembly according to embodiments of the present disclosure.

As shown in FIG. 5, in some embodiments, the assembly 100 may include a plurality of posts 105A, 105B positioned adjacent one another. The assembly 100 may include main body 102A and main body 102B, each including respective support assemblies 104A and 104B. It will be appreciated that main bodies 102A, 10B and support assemblies 104A, 104B may be the same or substantially the same as those described above with reference to FIGS. 1-4. As such, additional details of main bodies 102A, 10B and support assemblies 104A, 104B are omitted for the sake of brevity.

As shown, the assembly 100 may include the plurality of reinforcing bars 128 extending through the main bodies 102A, 102B and support assemblies 104A, 104B. That is, a same reinforcing bar 128A, extending in the x-direction, may pass through each of the main bodies 102A, 102B, and a same reinforcing bar 128B may extend through each of the support assemblies 104A, 104B. In the embodiment shown, main body 102A is spaced apart from main body 102B by a gap 188. In other embodiments, main body 102A may be directly coupled to main body 102B. It will be appreciated that the distance between main body 102A and main body 102B can vary depending on the security objectives for the assembly 100. Furthermore, main body 102A and main body 102B may be angled and/or offset relative to one another in other embodiments.

Figure 6:
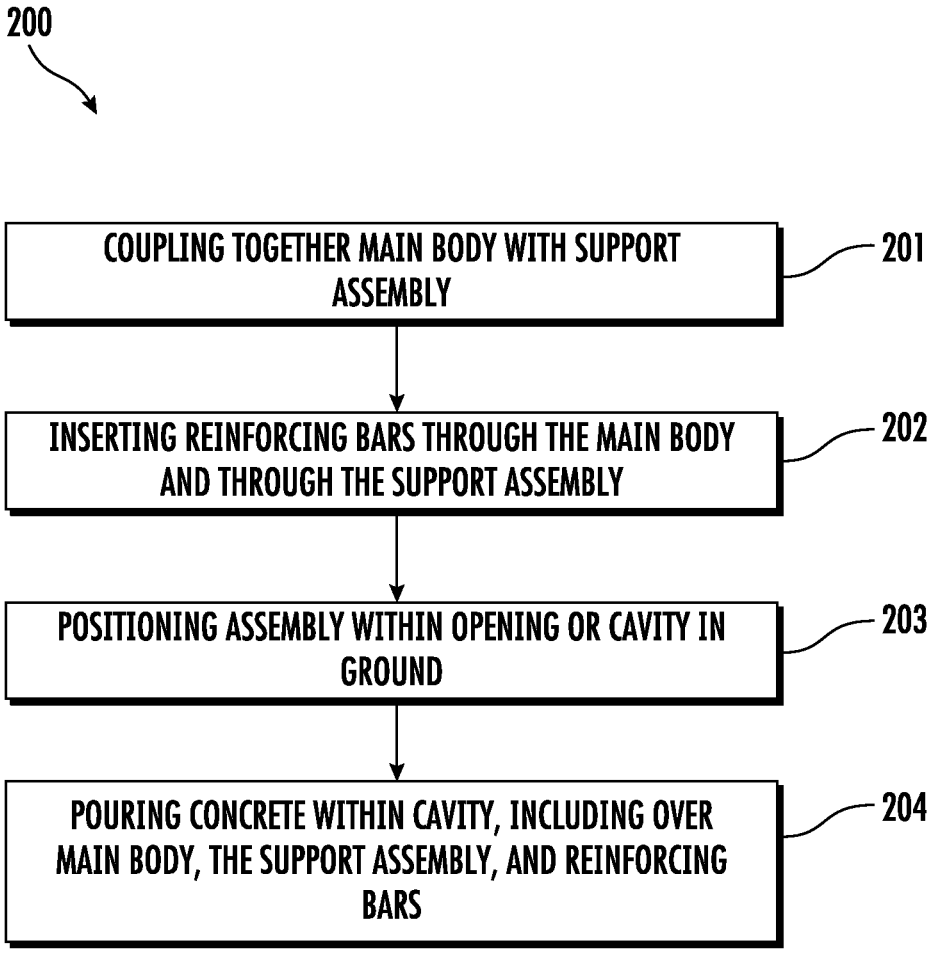
FIG. 6 is flow chart of a method for installing an ultra-shallow bollard assembly according to embodiments of the present disclosure.

Turning now to FIG. 6, a method 200 for installing an example assembly will be described. Reference will be made to the assembly 100 described herein. At block 201, the method may include coupling together the main body 102 with the support assembly 104. For example, the support assembly 104 may be inserted into the main body 102, between the upper plate 120 and the lower plate 122. In some embodiments, each of the support bars 126 of the support member 104 may be inserted between the set of guide members 169, which are located at the second end 146 of the main body 102, until the support bars 126 engage with the stop member 168.

At block 202, the method 200 may include inserting the reinforcing bars 128 through the main body 102 and through the support assembly 104. In some embodiments, the plurality of reinforcing bars 128 extend between the upper plate 120 and the lower plate 122 of the main body 102. In some embodiments, the plurality of reinforcing bars 128 extend through the openings 166 of the plurality of support members 124 and through the openings 181 of the support bars 126 of the support assembly 104.

At block 203, the method 200 may include positioning the assembly 100 within the opening or cavity in the ground. As noted above, the cavity 130 may have a depth of approximately 10" and a width 'W' of approximately 120". The lower plate 122 of the main body 102 may be positioned atop the bottom layer 134 of the ground 132, while the upper plate 120 may be recessed below the upper layer 136 of the finished grade of the ground 132. In some embodiments, the method 200 may include securing a plurality of anchors to the lower plate 122, e.g., through openings 162.

At block 204, the method 200 may include pouring concrete within the cavity 130, including over the main body 102, the support assembly 104, and the plurality of reinforcing bars 128. The post 105 of the assembly 100 will extend through and above the concrete.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

The terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A vehicle barrier, comprising:

a main body including a first end surrounding a post, wherein the main body is operable to be positioned below grade, wherein the post is operable to extend above grade, and wherein the main body comprises:

an upper plate including an opening to receive the post;

a lower plate opposite the upper plate; and a plurality of support members extending between the upper plate and the lower plate, wherein the plurality of support members extend radially from a central axis extending through the post;

a support assembly coupleable with the main body, wherein the support assembly comprises:

at least one support bar insertable between the upper plate and the lower plate, the at least one support bar comprising a first end adjacent the post and a second end extending outside the main body; and a cross member directly coupled to the second end of the at least one support bar; and a set of guide members located at a second end of the main body, separate from the plurality of support members, wherein the set of guide members are operable to receive the support assembly therebetween, and wherein the set of guide members are directly coupled to both the upper plate and the lower plate.

2. The vehicle barrier of claim 1, wherein the at least one support bar of the support assembly comprises a first support bar extending parallel to a second support bar.

3. The vehicle barrier of claim 2, wherein the support assembly further comprises the cross member coupled to the first and second support bars.

4. The vehicle barrier of claim 1, further comprising a stop member extending from the lower plate of the main body, wherein the at least one support bar is operable to and abut the stop member.

5. The vehicle barrier of claim 1, further comprising a plurality of reinforcing bars extending between the upper plate and the lower plate of the main body.

6. The vehicle barrier of claim 5, wherein the plurality of reinforcing bars extend through openings of the plurality of support members of the main body.

7. The vehicle barrier of claim 5, wherein a first reinforcing bar of the plurality of reinforcing bars extends through at least two support members of the plurality of support members.

8. The vehicle barrier of claim 7, wherein a second reinforcing bar of the plurality of reinforcing bar extends through the at least one support bar of the support assembly.

9. The vehicle barrier of claim 1, wherein each of the plurality of support members is a plate extending vertically from an upper surface of the lower plate.

10. A bollard assembly, comprising:

a main body surrounding a post, wherein the main body is operable to be positioned below grade, wherein the post is operable to extend above grade, wherein the main body includes an impact end and a back end, and wherein the main body comprises:

an upper plate including an opening to receive the post;

a lower plate opposite the upper plate; and a plurality of support members extending between the upper plate and the lower plate, wherein the plurality of support members extend radially from a central axis extending through the opening and the post;

a support assembly extending from the back end of the main body, wherein the support assembly comprises:

a support bar insertable between the upper plate and the lower plate, the support bar comprising a first end adjacent the post and a second end extending outside the main body; and a cross member directly coupled to the second end of the support bar; and a set of guide members located at a second end of the main body, separate from the plurality of support members, wherein the set of guide members are operable to receive the support assembly therebetween, and wherein the set of guide members are directly coupled to both the upper plate and the lower plate.

11. The bollard assembly of claim 10, wherein the support assembly further comprises:

a second support bar, wherein the support bar and the second support bar extend parallel to one another, wherein the cross member is further coupled to the second support bar, and wherein the cross member extends perpendicular to the support bar and the second support bar.

12. The bollard assembly of claim 10, further comprising a stop member extending from the lower plate of the main body, wherein the at least one support bar is operable to abut the stop member.

13. The bollard assembly of claim 10, further comprising a plurality of reinforcing bars extending between the upper plate and the lower plate of the main body.

14. The bollard assembly of claim 13, wherein a first reinforcing bar of the plurality of reinforcing bars extends through at least two support members of the plurality of support members, and wherein a second reinforcing bar of the plurality of reinforcing bar extends through the support bar of the support assembly.

15. The bollard assembly of claim 13, wherein each of the plurality of support members is a plate extending vertically from an upper surface of the lower plate, and wherein two or more support members of the plurality of support members include an opening.

16. A bollard assembly, comprising:

a main body surrounding a post, wherein the post extends perpendicular to the post, wherein the main body is operable to be positioned below grade, wherein the post is operable to extend above grade, and wherein the main body comprises:

an upper plate including a first opening to receive the post;

a lower plate opposite the upper plate, the lower plate including a second opening to receive the post; and a plurality of support members extending between the upper plate and the lower plate, wherein the plurality of support members extend radially from a central axis extending through the opening and the post;

a support assembly coupleable with the main body, wherein the support assembly comprises:

a support bar insertable between the upper plate and the lower plate, the support bar comprising a first end adjacent the post and a second end extending outside the main body; and a cross member directly coupled to the second end of the support bar; and a set of guide members located at a second end of the main body, separate from the plurality of support members, wherein the set of guide members are operable to receive the support assembly therebetween, and wherein the set of guide members are directly coupled to both the upper plate and the lower plate.

17. The bollard assembly of claim 16, wherein the support assembly further comprises:

a second support bar, wherein the support bar and the second support bar extend parallel to one another, wherein the cross member is further coupled to the second support bar, and wherein the cross member extends perpendicular to the support bar and the second support bar.

18. The bollard assembly of claim 16, further comprising a stop member extending from the lower plate of the main body, wherein the support bar is operable to abut the stop member, wherein the stop member extends between two adjacent support members of the plurality of support members, and wherein the stop member is oriented perpendicular to the support bar.

19. The bollard assembly of claim 17, further comprising a plurality of reinforcing bars extending between the upper plate and the lower plate of the main body, wherein a first reinforcing bar of the plurality of reinforcing bars extends through at least two support members of the plurality of support members, and wherein a second reinforcing bar of the plurality of reinforcing bar extends through the support bar of the support assembly.

20. The bollard assembly of claim 16, wherein each of the plurality of support members is a rectangular plate extending vertically from an upper surface of the lower plate, and wherein the support bar is an I-beam.

* * * * *